United States Patent [19]

Talbert et al.

[11] 4,188,172

[45] Feb. 12, 1980

[54] METHOD AND MEANS FOR INJECTING HOT LIQUID WHEN PUMPING COLD LIQUID

[75] Inventors: Sherwood G. Talbert; Thomas A. Klausing, both of Columbus; Jan B. Yates, Reynoldsburg, all of Ohio

[73] Assignee: The United States of America as represented by the Secretary of the Navy, Washington, D.C.

[21] Appl. No.: 909,312

[22] Filed: May 24, 1978

[51] Int. Cl.[2] ..... F04B 39/00; F04B 39/06

[52] U.S. Cl. ..... 417/53; 222/146 H; 417/431

[58] Field of Search ..... 222/146 H, 146 HS, 146 HE; 417/53, 54, 431; 302/14

[56] References Cited

U.S. PATENT DOCUMENTS

| | | | |
|---|---|---|---|
| 143,810 | 10/1873 | Cowell | 222/146 HS |
| 1,264,688 | 4/1918 | Schilling | 302/14 |
| 1,376,877 | 5/1921 | Herron | 417/53 |
| 2,148,131 | 2/1939 | Packer | 417/54 |
| 3,560,111 | 2/1971 | Sterlini | 417/54 |
| 3,561,645 | 2/1971 | Hopkins | 222/146 H |
| 3,583,415 | 6/1971 | Smith | 222/146 HS |

*Primary Examiner*—William L. Freeh

*Attorney, Agent, or Firm*—R. S. Sciascia; L. I. Shrago; C. E. Vautrain, Jr.

[57] ABSTRACT

A method of and means for introducing a heated liquid into a cold liquid for the purpose of improving the pumping rate of the cold viscous liquid is provided. The heated liquid is directed upward into the suction inlet of the cold liquid pump through an orifice or a multiplicity of small orifices which are disposed a selected distance below the suction inlet.

3 Claims, 3 Drawing Figures

METHOD AND MEANS FOR INJECTING HOT LIQUID WHEN PUMPING COLD LIQUID

This invention concerns enhancing the pumping of viscous liquids such as cold oil, syrup, molasses and the like and, more particularly, a method of and means for combining heated liquid and cold liquid which does not require the use of heating equipment or mixing structures in the vicinity of the cold liquid pump inlet.

In the transportation or conduction of viscous liquids from a storage unit such as a tank to another storage unit or a device using or receiving the liquid, difficulty is encountered not only in initiating movement due to the inherent resistance of the liquid to flow but also in maintaining a steady and constant flow at a desired rate without the requirement of excessively high pressures or excessively large conduits. In particular, in pumping cold viscous cargoes such as oil from striken tanker vessels the inaccessibility of the striken vessels makes it difficult and costly to provide external means for either heating the cold cargo in transit or introducing heated liquid thereinto in complex and bulky structures. The present invention avoids the need for such heating and mixing equipment by providing a system for directly injecting heated liquid into the cold liquid to reduce the liquid viscosity to a level compatible with the pumping requirements of several types of pumps.

Accordingly, it is an object of the present invention to provide a method and means for transferring viscous liquid materials from a remote and perilous location to a more accessible container or site which does not require heating the transfer conduits or mixing heated similar or dissimilar liquid with the cold liquid in multi-chambered structures.

Another object of this invention is to provide a method and means for transferring cold viscous liquid from striken vessels or other remote locations which permits injecting heated liquid into the cold liquid in the vicinity of the cold liquid pump inlet so as to substantially reduce the viscosity of the liquid being transferred.

A further object of this invention is to provide a system for pumping cold liquid from stranded or sunken tankers which permits the injection of heated liquid directly into the cold liquid transfer conduit without appreciable heat loss to either the surrounding liquid or the transfer means.

Other objects, advantages and novel features of the invention will become apparent from the following detailed description thereof when considered in conjunction with the accompanying drawing in which like numerals represent like parts throughout and wherein.

The present invention, in general, concerns a viable solution of many applications in which cold, high viscosity Bunker C oil or other liquid is required to be pumped from remote locations such as the holds of striken tankers with as much facility as possible. A multiplicity of small orifices are provided in an injection nozzle which is positioned below and in close proximity to a suction inlet to reduce the high viscosity of the cold liquid easily and quickly. The orifices being directed toward the cold inlet conserves the heated liquid as well as rapidly increasing the flow of liquid out of the container or tank.

Figure 1:
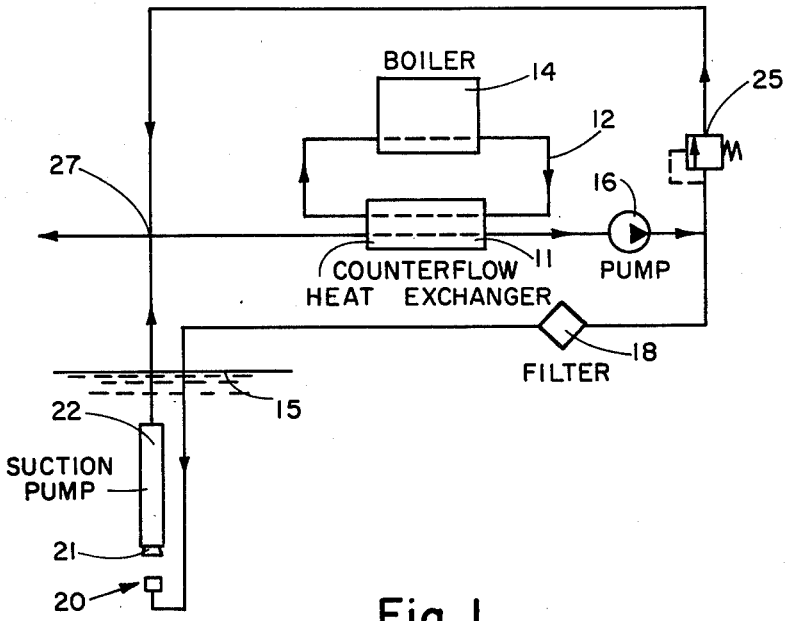
FIG. 1 is a schematic diagram of a circuit embodying the present invention for use with a system for pumping cold liquid.
Figure 2:
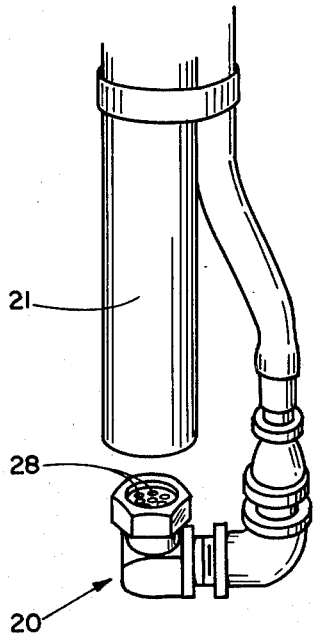
FIG. 2 is a perspective view of the embodiment of FIG. 1 showing the relative positions of a heated liquid supply nozzle and the cold liquid pump inlet.
Figure 3:
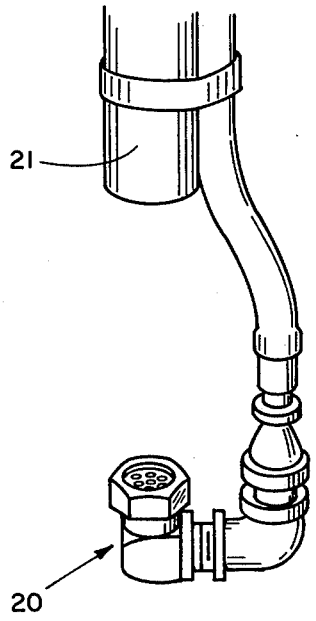
FIG. 3 is a perspective view of the embodiment of FIGS. 1 and 2 showing the adaptation of the invention to effect mixing of lower viscosity cold liquid over a greater distance between the nozzle and pump inlet.

Referring to the drawing, FIG. 1 is a circuit schematic of an embodiment of the invention in which a counterflow heat exchanger 11 is heated through a loop 12 which conducts any suitable liquid from a boiler 14 to the heat exchanger. The pumping system is initially primed with a selected liquid, preferably of the same type as the cold liquid to be pumped and whose level is indicated at 15. A pump 16 pumps the heated liquid through a filter 18 to a nozzle 20 which is immersed in liquid 15 and spaced a selected distance from an inlet 21 of a cold liquid suction pump 22 which in this embodiment is an immersion pump. A safety relief valve 25 is inserted in a return line 26 of the system which terminates in a four-way junction 27. FIG. 2 is a perspective view of nozzle 20 and inlet 21 and illustrates a selected initial positioning of a plurality of orifices 28 in the nozzle through which the heated liquid is directed generally upward into the suction pump inlet. FIG. 3 shows nozzle 20 displaced a much greater distance from inlet 21 after a desired rate of flow has been induced through the suction pump, or in an alternate case, where the viscosity of the liquid to be pumped is sufficiently low in relation to the distance of nozzle 20 from inlet 21 to permit such initial spacing.

The embodiment of FIGS. 1–3 is applicable for use in a specific system having a boiler capable of producing 12,000,000 Btu per hour up to a 400° F. output, a counterflow type heat exchanger having a capability of 10,200,000 Btu per hour and a 5 psi pressure drop at 350° F., a low restriction full-flow 300 psi filter, and a 250 gpm 350° F. pump having a rated flow of 200 psi and a reduced flow of 300 psi.

The method of the invention is applicable generally to compact pump configurations of either the centrifugal or the positive-displacement type which are used conventionally to remove high-viscosity Bunker C oil, crude oil, or other viscous cargoes from striken vessels. The hot liquid injection nozzle directs heated liquid upward from a multiplicity of small orifices in the nozzle, through the liquid occupying the space between the nozzle and the inlet, and into the suction inlet of the suction pump. The orifices preferably are located at a distance of from one to two pump-inlet diameters below the suction pump inlet. However, this distance may be extended depending upon the viscosity of the cold liquid. For example, a desired net flow of 750 gpm of 35° F. Bunker C oil may be moved with a suction pump having an inlet diameter of 8 inches, a hot oil injection nozzle having seven 0.37-inch diameter orifices in a 3.0-inch-diameter circle positioned 16 inches below the center of the pump inlet. With an upstream pressure of substantially 200 psig, this injection nozzle would move substantially 250 gpm of 300° F. oil and create a mixed oil temperature of about 100° F. at the suction pump inlet.

There is thus provided a system for injecting heated liquid into cold, high-viscosity liquid near the inlet to a pump being used for transferring or off-loading the cold liquid. Directing the heated liquid through one or more small orifices and into the pump inlet both confines the area where hot and cold liquids are mixed and produces a straight-flow aspiration effect which substantially increases the flow rate of the transferred liquid. The size and number of orifices may be varied within the inventive concept to most effectively increase the flow of different liquids at different viscosities. This heating method efficiently and effectively reduces the viscosity of the liquid entering the transfer pump to a level where it is compatible with the characteristics of several types of pumps, some of which are the progressing-cavity, turbine and positive displacement pumps.

The invention may also be employed to aid in liquifying substances which are too viscous to flow into the area of the cold liquid inlet without being heated. For example, some oils are like wax and below a specific temperature, often as high as 70° F., will not flow unless the oil is pushed toward the pump inlet or is heated sufficiently to be melted. In such cases, the orifices pointing toward the inlet would only be effective in pumping out an area near the inlet. By heating the periphery of this pumped-out area using jets of liquid from the same source as that injected through the orifices but instead directed laterally into the pumped-out area from supplementary orifices positioned around the pump inlet, the area of melting and the amount of liquid recovered both can be substantially increased.

Although viscous oils may be the primary liquids of interest in using the invention, it is also applicable to other viscous liquids and syrups such as molasses which are transported in bulk and whose transfer is susceptible to acceleration by the method and means disclosed. In addition to expediting the transfer of viscous liquids, the invention requires no heating hardware such as heating coils or other heating means to be disposed in the liquid to be transferred, it reduces heat loss to a minimum since the liquid is heated locally only at the pump inlet, it avoids contaminating the liquid with detergents, water or other viscosity reducing agents, and it permits a large heating capacity to be deployed through a small opening. The requirement for a defined heat transfer area is eliminated since the hot liquid mixes directly with the cold liquid, and the amount of heat transferred is not limited by the area of the heat exchanger since it is not placed in the liquid.

Obviously many modifications and variations of the invention are possible in the light of the foregoing teachings. For example, the orifices can be canted slightly inwardly to more precisely direct the injected heated liquid into the inlet when greater spacing therebetween is desired.

What is claimed is:

1. A pumping system for removing viscous liquids at substantially increased flow rates from tanks in vessels or at other sites to other storage or transfer means comprising:

pumping means including a suction pump immersed in said liquids for removing lowered viscosity liquids therefrom, said pump disposed in a substantially vertical attitude in said liquids and having an inlet at the lower end thereof;

means remote from said liquids for heating and initiating flow of said liquids, said remote means including a priming liquid, a boiler and a counterflow heat exchanger for transferring heat to said liquids, said priming liquid substantially identical to said liquids to afford blending therewith;

means for injecting said heated liquids into said suction pump, said injecting means including a nozzle positioned below said inlet and having at least a plurality of orifices so formed as to direct said liquids into said inlet, said injecting means spaced from said pump to create an aspiration effect enhancing entry of said heated liquids into said inlet;

means coupling said pump to said boiler to return a portion of said liquids to said injecting means, said means for initiating flow being a second pump and a filter connected in series between said counterflow heat exchanger and said nozzle; and a relief valve connected in parallel across said second pump and said coupling means, said pumping means further including a discharge line having a common connection with said suction pump, said relief valve and said heat exchanger.

2. The system as defined in claim 1 wherein said orifices are positioned a distance substantially equal to one to two inlet diameters below said suction pump inlet.

3. A method of substantially increasing the transfer rate of a cold high-viscosity liquid comprising:

initially feeding a heated quantity of a similar liquid through a plurality of orifices to form a stream of said similar liquid;

injecting said stream of liquid into a suction pump immersed in said high-viscosity liquid whose inlet is selectively spaced from said orifices to promote mixing with and heating of said high viscosity liquid;

varying the spacing between the orifices and the inlet in inverse relation to the viscosity of said high-viscosity liquid;

recirculating an additionally heated portion of the liquid discharged from said suction pump through said orifices to sustain an increased transfer rate of said high-viscosity liquid; and heating said recirculated liquid in a counterflow heat exchanger and pumping said recirculated liquid therefrom through a filter to said orifices, the flow between said orifices and said inlet being substantially vertical and the orifices being initially positioned a distance substantially equal to one to two inlet diameters below the inlet for liquids having substantially the viscosity of Bunker C oil at a temperature of substantially 35° C.

* * * * *